US005203692A

United States Patent [19]

Wexoe

[11] Patent Number: 5,203,692

[45] Date of Patent: Apr. 20, 1993

[54] BURNER FOR SOLID AND LIQUID OR GASEOUS FUEL

[75] Inventor: Mads Wexoe, Valby, Denmark

[73] Assignee: F. L. Smidth & Co. A/S, Denmark

[21] Appl. No.: 647,535

[22] Filed: Jan. 29, 1991

[30] Foreign Application Priority Data

Jan. 29, 1990 [DK] Denmark ..... 0232/90

[51] Int. Cl.[5] ..... F23D 17/00; F23K 5/02

[52] U.S. Cl. ..... 431/284; 431/285; 431/181; 431/187; 431/247; 110/262

[58] Field of Search ..... 431/11, 181, 182, 243, 431/242, 247, 278, 284, 285, 159, 160, 208, 187; 110/260, 261, 262, 264, 265; 239/128, 129, 135, 139

[56] References Cited

U.S. PATENT DOCUMENTS 2,335,188 11/1943 Kennedy ..... 431/285 X
3,149,613 9/1969 Anshutz et al. ..... 431/160 X
3,260,301 7/1966 Zoschak et al. ..... 431/284 X
4,208,180 6/1980 Nakayasa et al. ..... 431/284

FOREIGN PATENT DOCUMENTS 2905746 8/1980 Fed. Rep. of Germany .
3027587 2/1982 Fed. Rep. of Germany .

*Primary Examiner*—Carl D. Price
*Attorney, Agent, or Firm*—Brumbaugh, Graves, Donohue & Raymond

[57] ABSTRACT

A burner (1) for feeding solid and liquid or gaseous fuel into a burning zone (8) of a kiln, for instance a rotary kiln, and comprising central duct (2) for liquid or gaseous fuel, a surrounding annular duct (3) for primary air and a further surrounding annular duct (4) for solid fuel is provided with an outer duct system (5) for feeding yet an amount of primary air into the burning zone (8), the duct system (5) being in the form of a heat exchanger for transferring heat from the inner kiln compartment surrounding the burner (1) to the primary air transported in the duct system (5) and thereby increasing the velocity of the air passing through the system without any corresponding increase of the fan power or the energy consumption of the kiln plant, but with a substantial decrease in the amount of primary air fed to the burning zone. The duct system (5) is separated from the remainder parts of the burner (1) by an insulating layer (7).

6 Claims, 4 Drawing Sheets 1
2
2'
3
4
5
5'
5''
6
6'
7
18
18'
19
20

BURNER FOR SOLID AND LIQUID OR GASEOUS FUEL

BACKGROUND OF THE INVENTION

The invention relates to a burner for feeding solid and liquid or gaseous fuel into a burning zone of a kiln, for instance a rotary kiln.

Such burners are known for instance from the German patent specifications DE 2905746 and DE 3027587 and may comprise an outer burner tube in which is mounted a central channel ending in a spray nozzle for feeding burning liquid or gaseous fuel such as heavy fuel oil, waste products of solvents, lubricating oils, natural gas and the like and primary air into a burning zone of a kiln for the heat treatment such as sintering in same of the kiln products, an concentric channel or a channel system surrounding the central channel which concentric channel(s) feeds/feed combustion air as primary air into the burning zone and which may be provided with air nozzles for creating an air swirl in the burning zone and yet another concentric channel surrounding the primary air feeding channel(s) for feeding solid fuel into the burning zone. The necessary combustion air for a sufficient combustion in the burning zone of the kiln is provided partly by the primary air fed to the burning zone through the burner proper, cf. above, partly by secondary air such as spent cooler air from the kiln cooler fed directly to the burning zone. The primary air from such burners has to be fed to the burning zone at a high velocity rate as it is imperative for maintaining an appropriate size of the burning flame that the burner provides a considerable momentum feed of fuel and air per time unit.

The burner thus ejects jets of fuel and primary air and these jets have also to be powerful enough to be able to take in the total amount of secondary air into the burning zone and to form air/material recirculation zones in same ensuring the ignition of the fuel.

This momentum feed per time unit is a combination of the total of mass flows (kg/s) out of the burner multiplied by their respective outlet velocities (m/s). Usually the primary air has to be fed to the burning zone in a fairly cold state by fans or compressors ensuring a sufficiently high air velocity for the desired jet effect, because such fans or compressors might be damaged in case heated gases and especially in case heated, dust-laden gases were used as primary air. Further, preheating of the primary air has hitherto been avoided a.o. due to the risk of coking or preignition of the fuel before the latter arrives into the burning zone or risk of the burner construction loosing its mechanical strength through the heating and thereby being bent by its own weight. However, the use of cold, primary air causes an undesired heat loss in the kiln system as such and efforts have therefore been made to reduce the amount of primary air (kg/s) in favour of a corresponding increase in the amount of secondary, preheated air to be fed to the burning zone. This could be obtained increasing only the velocity of the primary air for taking in the secondary air thereby keeping the amount of fed primary air to a minimum, but would in return entail the use of more complicated and expensive and thus also more vulnerable and heavier fan equipment such as compressors instead of the normally preferred, simple centrifugal fans.

SUMMARY OF THE INVENTION

It is therefore the object of the invention to provide a burner construction remedying the above drawbacks by reducing the amount of primary air to be fed to the burning zone of a kiln without having to increase the power consumption and thereby the air velocity in order to maintain the momentum feed per time unit of primary air which otherwise would need the use of heavy or complicated fan and/or compressor equipment in addition to already existing fan-equipment.

The object is obtained by means of a burner having a central fuel feed channel for liquid and/or gaseous fuel, a first concentric channel for primary combustion air, a second concentric channel surrounding the first concentric channel for feeding solid fuel, a ceramic layer or layer of light fibre material outside of the second concentric layer, and finally an arrangement of ducts outside of the amorphous layer. This last arrangement of duct serves as a heat exchanger whereby heat from the kiln heats combustion air in the ducts and causes it to expand and be accelerated into the burning zone.

BRIEF DESCRIPTION OF THE DRAWINGS

The invention will be explained in more detail with reference to the enclosed diagrammatical and non-limiting drawings in which.

DESCRIPTION OF THE PREFERRED EMBODIMENTS

Figure 1:
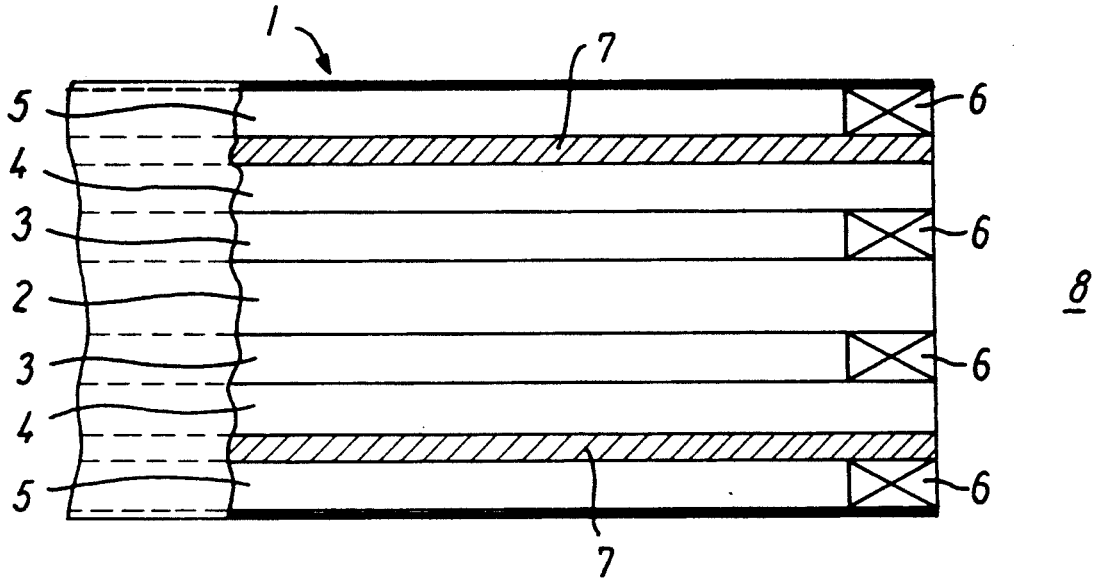
FIG. 1 is a sectional view along a diameter of a burner according to the invention.

In FIG. 1 is 1 a burner having a central channel 2 for feeding liquid or gaseous fuel into the burning zone 8 of a rotary kiln. A concentric channel 3 for feeding primary air into the burning zone 8 surrounds the central channel 2. A further concentric channel 4 surrounding channel 3 feeds solid fuel, for instance pulverized coal, into the burning zone for igniting in same the total amount of fuel and create the desired flame and heat effect in the sintering zone of the kiln. An insulating layer 7, which may be a ceramic layer or a layer of light fibre material surrounds concentrically the solid fuel feeding channel 4 and carries on its outer surface a system of further primary air feeding channels or ducts 5 which also acts as a heat exchanger transferring heat generated in the kiln compartment surrounding the burner 1 to the primary air being transported in the ducts 5. An adjustable annular air nozzle 6 for directing primary air into the burning zone is provided in a way known per se.

The insulating layer 7 functions to heat insulate the channel system 5 and also acts as a heat exchanger protecting the remaining inner parts of the burner 1 thus reducing the risks of coking the fuel in the fuel feeding channels and bending of the burner 1. Preferably the layer 7 should consist of light fibre material instead of heavier ceramic materials thereby reducing the total weight of the burner.

The materials used for the channel system 5 are preferably of a heat resistent type and strong enough for allowing burning kiln product particles to fall down upon the ducts. The materials for the channel system may thus be of a type similar to materials used for the manufacture of steam boiler tubes.

The primary air when passing through the channel system 5 will expand due to the heat effect and thereby cause an increase of the air velocity out of the channel system without needing any corresponding increase of the fan power providing the passage of the air through the system, and therefore also result in an air momentum increase without using any extra electric energy for the fan. Out of the total of primary air fed to the burning zone through the burner about 70% is fed through channel system 5.

Figure 2:
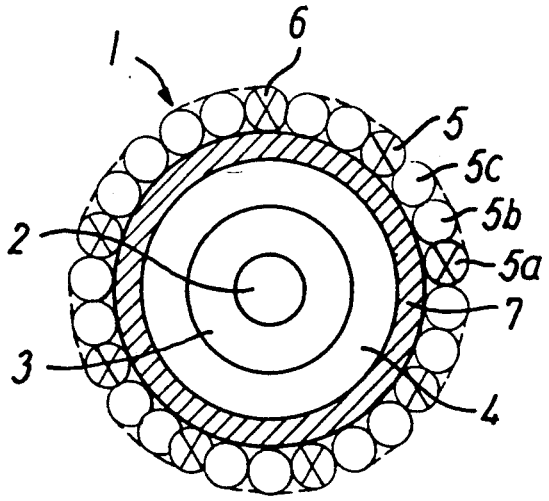
FIG. 2 is the burner shown in FIG. 1 seen from the end facing the burning zone.

In FIG. 2 is shown a channel system 5 comprising a number of numdles of ducts and in which each bundle 5*a, b* and *c* comprises a forward, a backward and a forward pointing duct, the latter being provided with a nozzle 6. The ducts are mounted parallel to each other and parallel to the axis of the burner 1 and are bundlewise interconnected in series.

In another embodiment the ducts 5 may follow a helical path around the burner 1. In yet another embodiment the channel system may consist of a number of ducts mounted parallel with the burner axis with transversely externally mounted ribs for increasing the heat exchange surface of the ducts.

Figure 3:
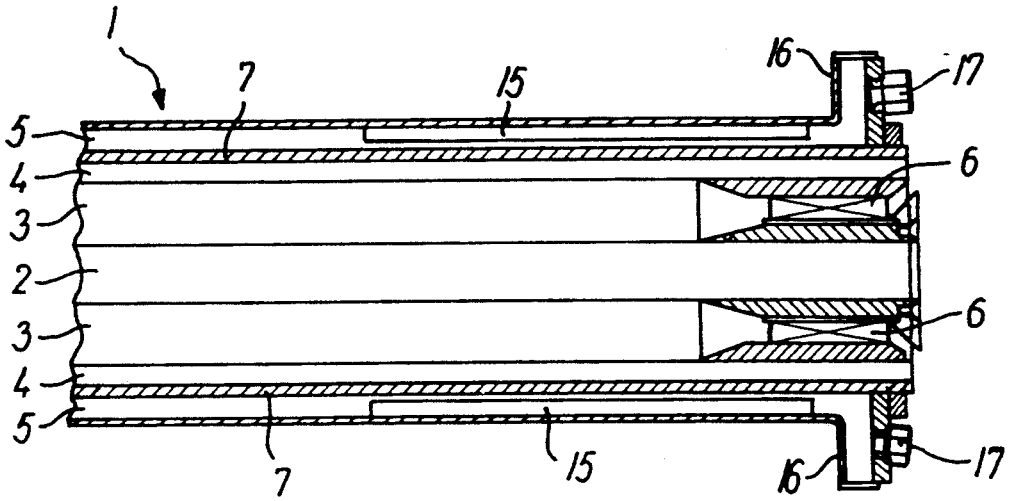
FIG. 3 shows another embodiment of the invention.
Figure 4:
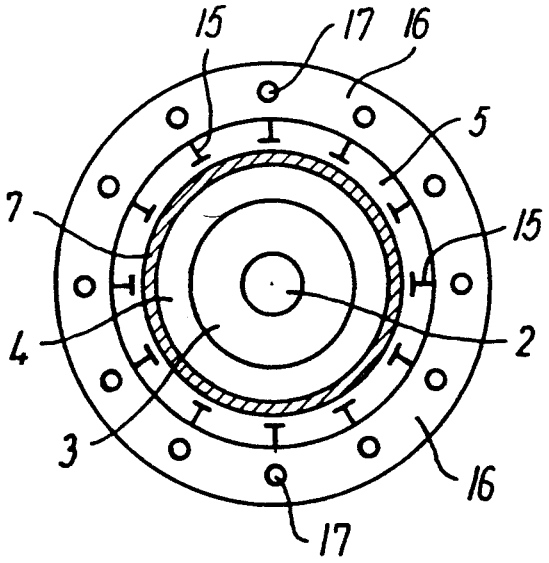
FIG. 4 is the burner shown in FIG. 3 and seen from the end facing the burning zone.

In FIGS. 3 and 4 the channel system acting as heat exchanger comprises an annular duct 5 having internally a number of ribs 15 mounted in the duct wall for guiding the primary air flow and providing an extended heat exchanger contact surface with the air flow. The duct 5 feeds the primary air into a protruding, annular chamber 16 mounted at the end of the burner 1 facing the burning zone 8. From chamber 16 the air passes through openings or fixed nozzles 17 in the chamber wall facing the burnzing zone 8 and forms in this zone immediately after each opening 17 a jet. These jets are located nearer to the kiln wall than possible with the burner according to FIG. 1 and enhance therefore the heat distribution from the flame within the burning zone 8 as will be explained in more detail in connection with FIGS. 5 and 6. The advantages of the invention according to the application are further illustrated in the example below.

Figures 6, 7:
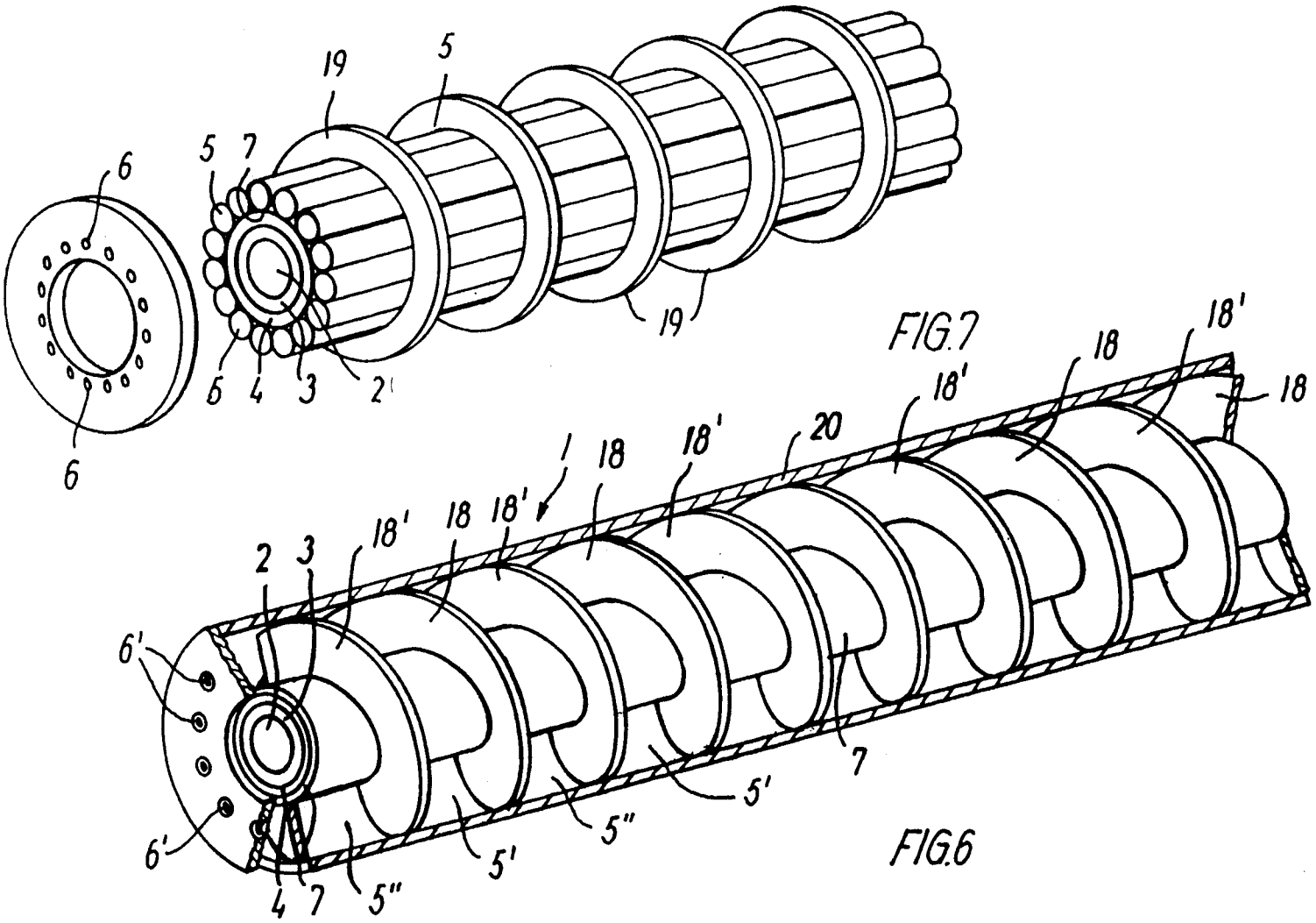
FIG. 6 shows partly in perspective and partly in section an embodiment of the invention with a helically formed heat exchanger channel system.
FIG. 7 shows partly in perspective and partly exploded an embodiment of the invention with externally mounted cooler ribs on the heat exchanger channel system.

Yet another embodiment is shown in FIG. 6, where the heat exchanger channel system consists of two parallel helical ducts 5', 5'' each separated by helical partitions 18, 18', respectively mounted externally on the insulating layer 7 and further covered by an outer burner shell 20 and having a number of openings or nozzles 6 in the burner end plate facing the burning zone. For the sake of clearness only the nozzles 6' belonging to the helical duct 5' are shown in FIG. 6.

A further embodiment is illustrated in FIG. 7, where a number of ducts 5 are mounted parallel to the burner axis. These ducts end in nozzles 6 in an annular nozzle plate (shown in an exploded view) facing the burning zone. The ducts 5 are externally provided with cooler ribs 19 for increasing the heat exchange surface of the ducts.

EXAMPLE

In a burner of a hitherto known construction for a cement rotary kiln with a separate preheater the primary air amounts to 10.5% of the minimum amount of combustion air ($A_{min}$) in the kiln with the addition of about 2% carrier air for solid, pulverous fuel.

To ensure a stable forming of the burner flame and a satisfactory clinker product the primary air typically must stream out into the kiln burning zone at a velocity of 110 m/secs which presupposes that the primary air fan yields a pressure of 900 mm WG. A pressure of this size is to be obtained by means of a normal centrifugal fan. The power of the primary air fan is proportional to the product of pressure and air volume flow, i.e. $900\times10.5=9450$ W. Thus in a plant of a given size the fanpower may amount to 9450 W and in the plant of the double size to 18900 W and so on.

To reduce the amount of primary air to 5.0% of $A_{min}$ maintaining a stable flame the primary air velocity has to be increased twofold, i.e. 230 m/sec. This fairly high air velocity demands a primary air fan pressure of nearly four times the normal pressure, i.e. 3500 mm WG. A pressure of this size could not be delivered by a centrifugal fan and a compressor would have to be used with a corresponding power increase of $3500\times5.0=17500$ W. The cost of obtaining a saving of calories of for instance 1.5 kcal/kg clinker per each saved percentage point of primary air (here 5%), i.e. about 8 kcal/kg clinker, would consequently mean an investment into a more expensive compressor and a double power consumption in same.

Using, however, the principle according to the invention in preheating the primary air to 400 C. during its passage through the burner and before it streams out into the burnzing zone and provided the primary air is fed to the burner at a temperature of 50 C. due to the compression of the air in the fan, the specific gravity of the primary air will decrease from 1.5 kg/m$^3$ to as low as 0.6 kg/m$^3$ enabling a high air outflow velocity into the burning zone of 230 m/sec to be maintained through a pressure yield in the fan as low as $0.6/1.5\times3500$ mm WG$=1400$ mm WG, which yield is within the obtainable from a current centrifugal fan type. The power consumption will thus decrease down to $1400\times5.0=7000$ W, however, maintaining the above calorie savings of 8 kcal per kg clinker.

In the above example it has been presupposed that the fan efficiencies have been the same in all situations. However, bearing in mind that in some fan types the efficiency will decrease at a higher fan pressure, it will be obvious that it is more advantageous to use a pressure of 1400 mm WG instead of 3500 mm WG thereby also being able to use a less expensive fan.

In addition to the above mentioned reduction of the power consumption of the primary air fan and the increase of the heat economy of the kiln plant the burner further contributes to a reduced $NO_x$-production of the kiln.

Figure 5:
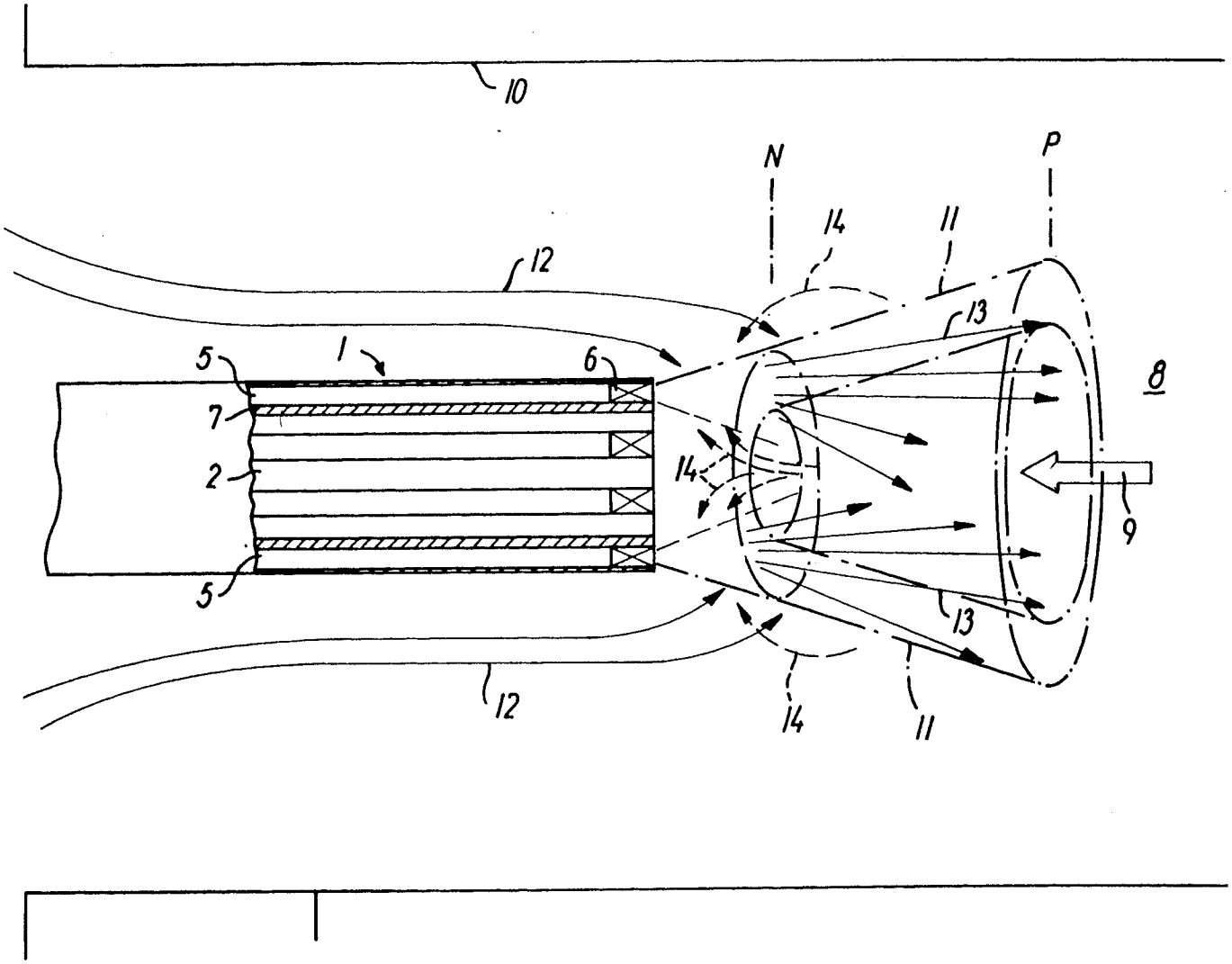
FIG. 5 shows in principle the functioning of the burner.

As shown diagrammatically in FIG. 5 primary air fed to the burning zone 8 of the rotary kiln 10 through which heat treated materials are passing in the direction indicated by arrow 9 form at each air outlet 6 small jets as indicated by dashed lines 15. These small, separate jets cause each of them a recirculation 14 of unburned combustion materials in the zone 8 due to lack of $O_2$ between the jets. Not until the path of the combustion particles has turned once more in the forward direction 13 will the particles gradually meet sufficient combustion air for a full combustion which is thus taking place in an area N-P of the burning zone 8. This flame has the form of a hollow, truncated cone as shown diagrammatically with dash-dotted lines 11 with nearly no combustion in its "hollow" part and with the substantial part of the combustion taking place near the "users of the heat", i.e. the heat treated materials and the kiln wall. In comparison with a flame concentrated near the central axis of the kiln, this hollow, cone shaped flame will be of a lower temperature, yet providing the same heat transmission to the heat treated materials. The lower temperature results from the air-fuel mixing pattern and despite this lower temperature the same heat transmission is made possible by location of the flame closer to the inner kiln wall. Since extremely high temperatures are avoided, and also due to the standard mixing of fuel and air, the NO-production rate is reduced by about 20% for the mainpart of used fuels.

It should be noted that with the embodiment of the invention according to FIGS. 3 and 4 a better heat distribution than that of the burner according to FIGS. 1 and 2 is obtained through the location of the hollow cone shaped flame closer to the kiln wall which also leads to higher degree of flame stability in the burning zone.

I claim:

1. Burner for feeding solid and liquid or gaseous fuel into a burning zone of a kiln, for instance a rotary kiln, the burner comprising an outer casing inside which is mounted a central fuel feed channel for liquid and/or gaseous fuel, a first concentric channel for feeding combustion air in the form of primary air into the burning zone and surrounding the central tube, a second concentric channel surrounding the first concentric channel and adapted for feeding pneumatically a solid fuel into the burning zone, and mounted outside of and surrounding the second concentric channel a plurality of annularly spaced ducts for feeding an amount of combustion air into the burning zone, characterized in that said plurality of annularly spaced ducts also form a heat exchanger for heating the combustion air being transported through said plurality of ducts by heat exchange with heat generated in that part of the kiln into which the burner extends, and in that the plurality of ducts is separated from the second concentric channel by a heat insulating ceramic layer or layer of light fibre material.

2. Burner according to claim 1, characterized in that the plurality of ducts are divided into a number of bundles of ducts, each bundle having forward and backward pointing parallel ducts interconnected in series and mounted parallel with the axis of the burner and each bundle being provided with an air nozzle at the end facing the burning zone.

3. Burner according to claim 1, characterized in that the plurality of ducts are arranged as mutually parallel ducts helically surrounding the channel with each duct ending in an air nozzle facing the burning zone.

4. Burner according to claim 1, characterized in that the plurality of ducts are axially mounted, a parallel ducts, each of which externally is provided with a number of transversely mounted radiator ribs.

5. Burner according to claim 1, characterized in that the plurality of ducts are internally provided with a number of transversely or parallelly mounted radiator ribs.

6. Burner according to claim 5, characterized in that the plurality of ducts includes a protruding annular chamber having a number of openings in the chamber wall facing the burning zone.

* * * * *